US005345608A

United States Patent [19]

Mergens et al.

[11] Patent Number: 5,345,608

[45] Date of Patent: Sep. 13, 1994

[54] UTILITY GLOVE

[76] Inventors: Peggy J. Mergens, P.O. Box 76, Bromfield, Colo. 80026; Walter J. McGrew, 17522 State Hwy. 8, Morrison, Colo. 80465

[21] Appl. No.: 94,270

[22] Filed: Jul. 21, 1993

[51] Int. Cl.[5] ..... A41D 13/00; A41D 19/00

[52] U.S. Cl. ..... 2/16; 2/159

[58] Field of Search ..... 2/159, 161.1, 161.6, 2/16, 20, 17, 158, 161.2, 161.3, 161.5, 161.8, 163, 166, 167, 168, 169; 128/878, 879; 602/20, 21; 273/26 C; 294/25

[56] References Cited

U.S. PATENT DOCUMENTS

| | | | |
|---|---|---|---|
| D. 275,219 | 8/1984 | Scales, Jr. | D21/234 |
| 342,341 | 5/1886 | Edwards | 2/21 X |
| 2,701,361 | 2/1955 | Depta, Jr. | 2/20 |
| 4,896,376 | 1/1990 | Miner | 2/161.1 X |

FOREIGN PATENT DOCUMENTS

| | | | |
|---|---|---|---|
| 2626444 | 8/1989 | France | 2/159 |
| 655229 | 7/1963 | Italy | 2/21 |

*Primary Examiner*—Clifford D. Crowder
*Assistant Examiner*—John J. Calvert
*Attorney, Agent, or Firm*—Charles C. Corbin

[57] ABSTRACT

Disclosed is a hand glove or mitt that has a semi-rigid polymeric molded construction with an open back, and includes a first portion having a recess for loosely receiving the thumb of the hand, another portion having a recess for the opposing fingers, and a central, palm-covering portion that adjoins the first and second portions, the molded glove being self-supporting in an initial configuration with the thumb-receiving portion spaced from the fingers-receiving portion so as to provide an article-receiving gap between these opposing portions, the glove being resiliently manipulatable from its initial configuration so as to widen or close the gap.

11 Claims, 2 Drawing Sheets

UTILITY GLOVE

BACKGROUND OF THE INVENTION

1. Field of the Invention

The present invention relates to gloves, mitts or the like, and more particularly to gloves having a molded three-dimensional self-supporting configuration.

2. Description of the Prior Art

Over the years gloves and mitts have been designed to serve many purposes, and the prior art is replete with a large variety of gloves and mitts. Some have constructions particularly designed to insulate the hands against cold weather and others have been developed for protecting the hands against heat, for example, and a myriad of gloves have been provided for sports enthusiasts in a great variety of sports. The prior art also includes many disclosures of work gloves, each featuring a construction that addresses the particular needs of the particular occupation. For example U.S. Pat. No. 2,895,139 discloses a moisture-proof glove designed for grasping a fish, for use in the fish processing industry. U.S. Pat. No. 3,643,386 shows a glove for protecting the user's hand while engaged in various tasks, and has special interior portions equipped with abrasive material for use in cleaning an object. In U.S. Pat. No. 4,094,014 is shown a protective glove useful as a mechanic's glove, and made of a flexible sheet of rubber or rubberized cloth and having knuckle-protecting pads, and non-slip gripping pads on certain portions of the glove. The glove shown in U.S. Pat. No. 4,942,626 is for use by medical personnel, and it has a construction designed to prevent accidental injuries when handling needles.

While these and other examples may meet the needs of their respective applications, they all appear to have certain limitations in common. This includes the requirement that, in putting on a pair of gloves, both hands must be used to manipulate the gloves over one's hands. After the first of a pair of gloves is put on, the gloved hand must then be used to put on the second glove, and it is well known that this can often be a cumbersome task. Similarly both hands are required to take off a pair of conventional gloves, manipulation of each of the thumb and finger-covering parts of the glove often being required to free the thumb and fingers. This can amount to an appreciable consumption of time, particularly when gloves are used in tasks requiring them to be put on and taken off on a relatively frequent basis. Another problem common to conventional gloves and mitts is that they are notoriously difficult to clean on their insides, and they must ordinarily be turned inside out to be properly Cleaned. There also appears to be a need for a utility glove that is adaptable for multi-purposes, for example, for protecting one's hand against sharp surfaces and against moisture and heat, while allowing a fair amount of dexterity and being easy to put on and take off. This would include, among other examples, a glove that is suitable for use in eating thorny shell fish such as crab.

SUMMARY OF THE INVENTION

In view of the foregoing, it is a general object of the present invention to provide a utility glove that can be put on the hand quickly and easily.

Another object of the invention is to provide for a pair of gloves, each of which can be put on and removed from one's hand without the assistance of the other hand.

A further object is to provide such gloves of the character referred to that have a molded, semi-rigid configuration with fixed-open recesses for the digits of the hand.

Yet another object of the invention is to provide a utility glove having one size that fits hands of a variety of sizes.

Still another object of the invention is to provide such a glove as above, that is waterproof and that resists penetration by sharp surfaces.

A further object of the invention is to provide a utility glove that has an open-back construction which enhances ventilation of the hand and minimizes sweating and heat build-up.

And yet another more particular object is to provide a pair of gloves that lend themselves to use in handling thorny shelled fish, such as crabs.

These and other objects and advantages are provided by the present invention of an open-backed utility glove having a first portion with a thumb-receiving aperture therein a second portion having a recess adapted to receive the opposing fingers of one's hand, and a central, palm-covering portion interconnecting the thumb-receiving and fingers-receiving portions, the glove featuring a semi-rigid construction by which said glove holds itself three dimensionally in an initial prehensile configuration, the digit-receiving recesses being maintained open so as to readily receive the thumb and fingers, and with the first glove portion held in opposition to the second glove portion to form an article-receiving gap, the glove being resiliently manipulatable in order to widen and close the gap. In a preferred embodiment the glove is constructed of a resilient, semi-rigid polymeric material and is adapted to support itself on a generally horizontal surface, with the digit-receiving recesses and the open back oriented in a generally upward direction for convenient insertion and removal of the thumb and fingers.

DETAILED DESCRIPTION OF THE INVENTION

Figure 1:
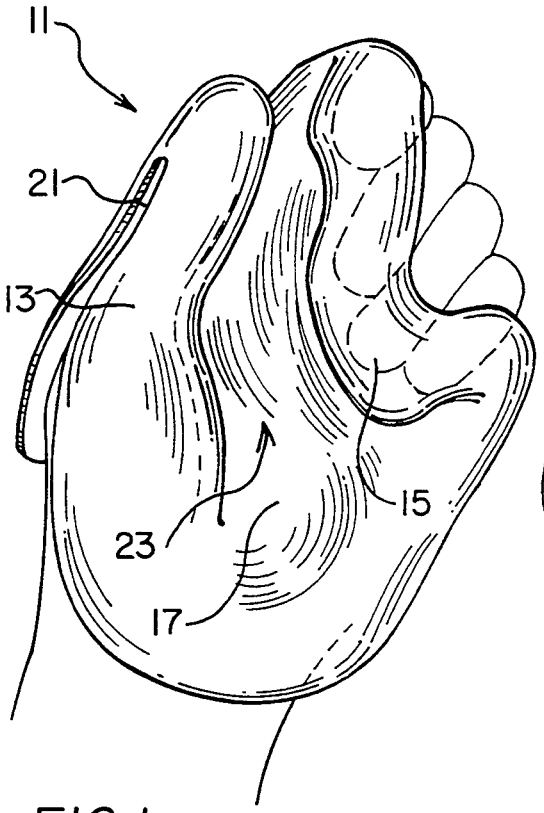
FIG. 1 is a front elevational view of a utility glove according to the present invention.
Figure 3:
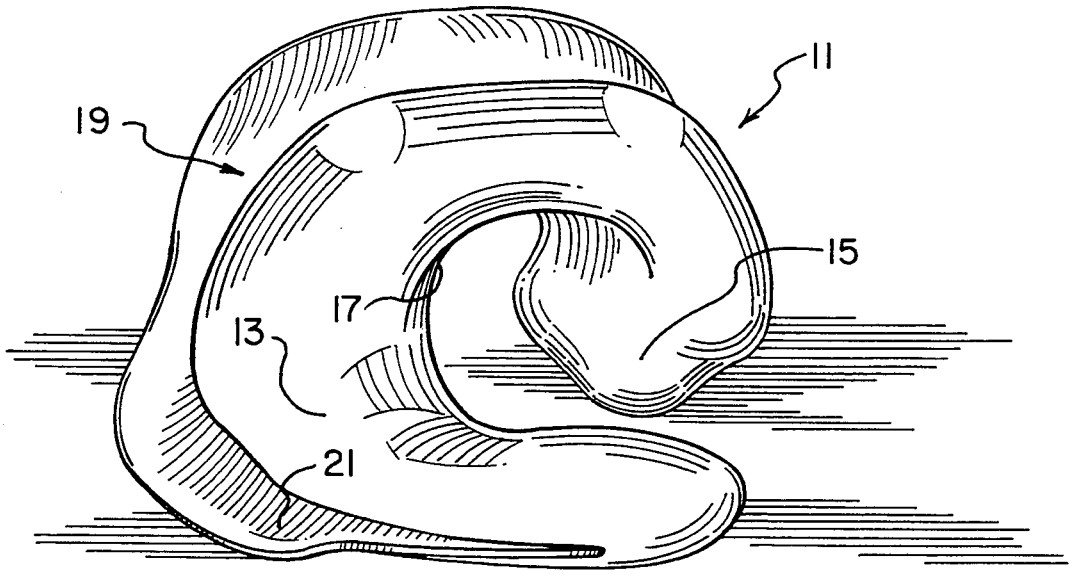
FIG. 3 is a perspective view thereof.

Referring now to the drawings, FIGS. 1 and 3 shows that a preferred embodiment of a utility glove 11 includes a portion 13 that is adapted to receive the thumb of the hand as illustrated, a portion 15 that is adapted to receive the opposing fingers also as illustrated in FIG. 1, and an integral interconnecting portion 17 that is designed to cover the anterior of the hand.

It is to be understood that glove 11 is molded of a suitable polymeric material and is uniquely characterized by having a semi-rigid and resilient structure by which it holds itself in three dimensions substantially in the configuration depicted in the drawings.

Figure 4:
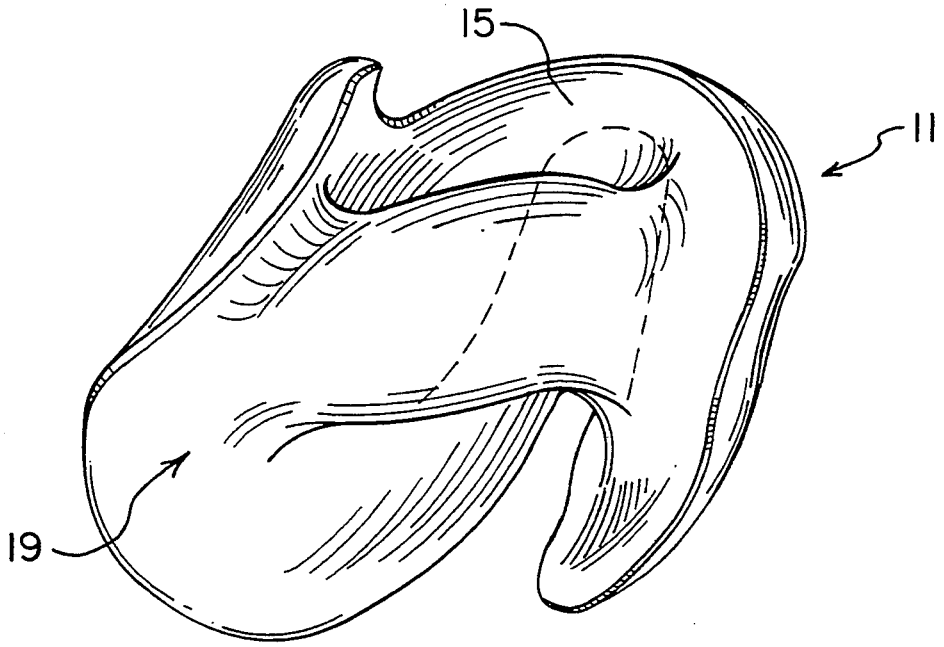
FIG. 4 is a rear view thereof.
Figure 5:
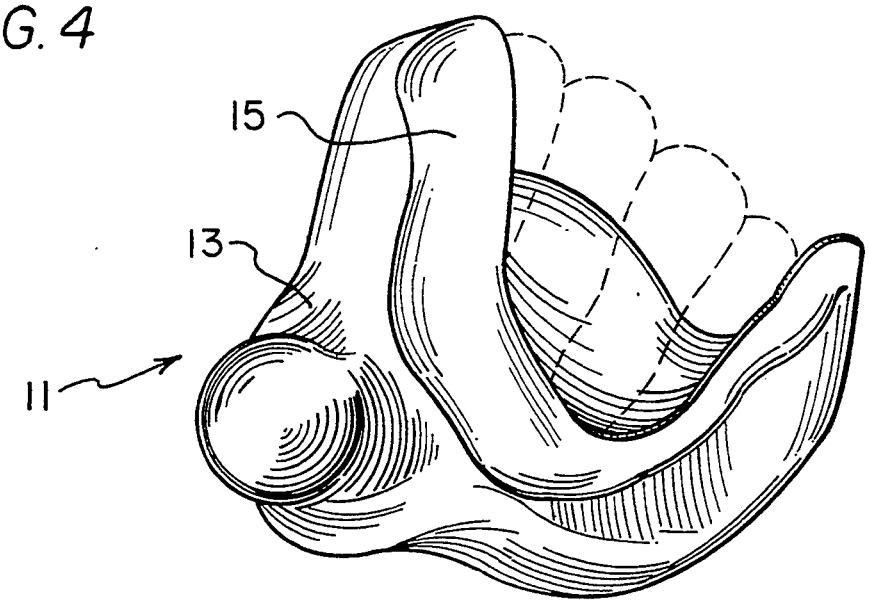
FIG. 5 is a top plan view thereof.

Continuing with the details of the glove 11, it is noted that it is substantially open-backed, as indicated by reference numeral 19 in FIGS. 3 and 4. In this regard note that the recess for receiving the fingers is designed to be engaged by primarily the distal phalanges of the fingers. Similarly the elongate slot 21 in the portion 13 ensures that only the distal part of the thumb will be fully enclosed. It will be seen that these features of glove 11 allow quick and easy placement of the hand within glove 11, and a high degree of ventilation of the hand. It is to be further noted that the thumb-receiving recess and the fingers-receiving recess are somewhat larger than those of most human hands and are maintained in an open configuration by virtue of the glove's semi rigid nature. Thus the thumb and fingers can be received in the respective recesses with a certain amount of looseness which allows them to be inserted and removed without encountering any frictional or binding engagement within these recesses.

Figure 2:
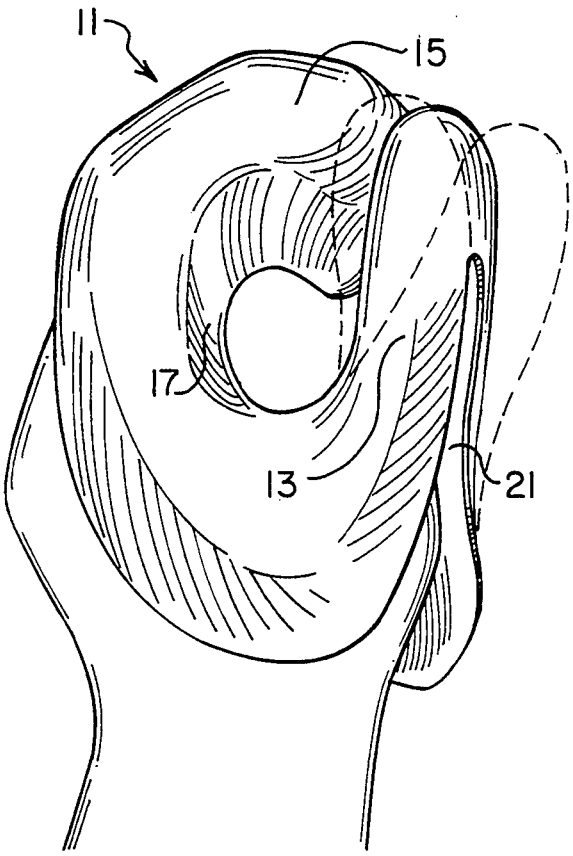
FIG. 2 is a side elevational view of a glove according to the present invention.

FIGS. 1–3 best show how glove 11 is molded in essentially a prehensile configuration, with the thumb-receiving portion 13 held in opposition to the finger-receiving portion 15 such that there is a gap 23, shown in FIG. 1, in which objects to be grasped can be inserted. Glove 11 is made to be sufficiently flexible to allow the fingers and thumb to manipulate the portions 13 and 15 resiliently towards and away from each other, as desired, to open and close the gap 23, as suggested by the broken lines in FIG. 2.

FIG. 3 illustrates how glove 11 can advantageously be stood upon a horizontal surface 31, with parts of the portions 13 and 15 engaging surface 31 to hold glove 11 stably in the position shown. When thusly positioned with its open back oriented generally upwardly as shown, glove 11 can easily and immediately receive one's hand, without the assistance of one's other hand. Similarly one can remove glove 11 simply by placing glove 11 on a surface as in FIG. 3, and then disengaging the thumb and fingers, and leaving the glove 11 in place on surface 31.

It is to be realized that, depending on the particular intended use of glove 11, various additional qualities can be imparted to the glove material to make glove 11 resistant to penetration by sharp edges, for example, and or to make it heat-resistent. Thus the invention will include a variant that is particularly useful for eating certain foods such as crab in-the-shell for example. Another variant can be designed for eating spare ribs. It is also contemplated that the invention can have special applications in certain work environments where sterility must be maintained, such as in the medical field and in "clean rooms" of the computer fabrication industry, particularly where it is desirable to take off and put on gloves fairly frequently.

In summary, while a particular embodiment of the invention has been described, it is not intended that the invention be limited thereto. Various modifications and variations may readily occur to those of ordinary skill in the art without departing from the true scope and breadth of the invention as defined in the claims which follow.

What is claimed is:

1. A glove for use when one eats thorny shellfish, said glove having an open back and a molded, semi-rigid, pliable construction, substantially the size and shape of a closed fist, and said glove comprising:

a first, thumb-receiving portion, a second, fingers-receiving portion spaced in opposition from said first portion, and a central, palm-covering portion adjoining said first and second portions and having a shape substantially contouring a partially closed palm;

wherein said thumb-receiving portion comprises a generally cylindrical thumb-shaped projection having an end comprising a socket for receiving a tip of the thumb of a hand, and said thumb-receiving portion includes first and second opposing protective walls extending rearwardly from said socket;

said fingers-receiving portion having an inwardly curved semi-cylindrical shape for receiving therein tips of the fingers and protecting the fingers, said fingers-receiving portion having a first, index finger side, and an opposite, pinkie finger side;

a protective side wall for covering the thumb-and-index finger side of the hand, and extending from the first protective wall of said thumb-receiving portion to the index finger side of said fingers-receiving portion; and said glove having a prehensile configuration and the spacing between said first and second portions defining a gap for receiving an article, said glove being resiliently deformable to close and open said gap.

2. A glove as defined in claim 1 wherein said material is a rubber-like polymeric material.

3. A glove as defined in claim 1 wherein said first and second portions are engagable with a generally horizontal surface to support said glove in a stable position on said surface.

4. A glove as defined in claim 1 wherein said glove is resistible to penetration by sharp edges.

5. A glove as defined in claim 1 wherein said glove is formed of material resistant the passage of heat.

6. A glove as defined in claim 2 wherein said material is waterproof.

7. A glove as defined in claim 1 wherein said thumb recess completely encloses only the distal phalange of the thumb, and said fingers recess encloses only the distal phalanges of the fingers.

8. A glove as defined in claim 1 wherein said opposing walls have opposing longitudinal edges that provide a slot that extends rearwardly from said socket.

9. A glove as defined in claim 1 including an elongate protective sidewall for covering the pinkie finger side of the hand, and extending rearwardly from the pinkie finger side of the fingers-receiving portion to the second protective wall of said thumb-receiving portion.

10. A hand protector comprising:

a palm guard having a shape substantially contouring a partially closed palm;

a thumb guard having a cylindrical shape;

an index through pinky finger guard having a shape of a partially closed hand;

said palm guard further comprising a support means between said thumb and index through pinky finger guard;

said hand protector further comprising a flexible, prehensile self-supporting configuration, and a size substantially equivalent to a closed fist;

a guard for the thumb-and-index finger side of a hand extending from said thumb guard to said index through pinkie finger guard and in a direction rearwardly from said palm; and said palm guard support means having a tensile folding capacity between said thumb guard and said index through pinky finger guard thereby enabling a suer to manipulate an article between said thumb guard and said index through pinky finger guard.

11. A hand protector as defined in claim 10 including a guard for the pinkie finger side of the hand, said guard extending rearwardly from the pinkie finger side of said index through pinkie finger guard, and along a side of said palm guard.

* * * * *